US005711053A

United States Patent [19]

Hafner

[11] Patent Number: 5,711,053

[45] Date of Patent: Jan. 27, 1998

[54] UN-LOCKABLE HINGE PINTLE LOCK AND METHOD OF USE

[76] Inventor: Bernhard T. W. Hafner, 830 Bayridge La., Port Orange, Fla. 32127

[21] Appl. No.: 622,676

[22] Filed: Mar. 26, 1996

[51] Int. Cl.[6] ..... E05D 5/12

[52] U.S. Cl. ..... 16/380

[58] Field of Search ..... 16/380, 381

[56] References Cited

U.S. PATENT DOCUMENTS

| | | | |
|---|---|---|---|
| 3,448,486 | 6/1969 | Wright | 16/381 |
| 3,464,241 | 9/1969 | Wellekens | 16/381 |
| 3,497,906 | 3/1970 | McFadden . | |
| 3,621,512 | 11/1971 | Johnson | 16/380 |
| 3,733,649 | 5/1973 | Nagy et al. | 16/380 |
| 3,969,788 | 7/1976 | McCullough | 16/326 |
| 4,073,037 | 2/1978 | Curry et al. . | |
| 4,085,650 | 4/1978 | Flynn . | |
| 4,116,514 | 9/1978 | Lawrence | 16/380 |
| 4,135,273 | 1/1979 | Holmes | 16/381 |
| 4,351,085 | 9/1982 | Suska | 16/380 |
| 4,864,692 | 9/1989 | Prevot et al. | 16/381 |
| 5,337,453 | 8/1994 | Bargesser | 16/380 |

FOREIGN PATENT DOCUMENTS

| | | | |
|---|---|---|---|
| 3314753 | 10/1984 | Germany | 16/380 |

*Primary Examiner*—Chuck Mah
*Assistant Examiner*—Donald M. Gurley
*Attorney, Agent, or Firm*—Paul S. Rooy

[57] ABSTRACT

An un-lockable hinge pintle lock wherein a pintle is removably constrained within knuckle bores by means of a lock tongue engaged with a pintle bore. The lock tongue is a component of a lock. The lock is constrained within a lock blade aperture in a lock blade, by means of a lock screw through a lock screw hole. The lock tongue is inserted through a lock blade knuckle aperture which communicates with the lock blade aperture, and thence into the pintle bore. The lock may be removed in order to permit pintle removal from the knuckle bores, which permits the lock blade to be removed from another blade to which it had been rotatably attached.

11 Claims, 5 Drawing Sheets

UN-LOCKABLE HINGE PINTLE LOCK AND METHOD OF USE

BACKGROUND OF THE INVENTION

1. Field of the Invention

This invention relates to hinges, and in particular to an un-lockable hinge pintle lock and method of use.

2. Background of the Invention

One of mankind's earliest security concerns has been for his physical safety. An aspect of preserving physical security is having a safe place within which to eat, rest, relax, in short, a place to call "home". Early man found caves featuring easily-defended cave mouths to provide security against marauding beasts, as well as against human rivals. As time went by, and human engineering capability increased, walled structures were built. Ultimately, these walled structures incorporated doors or gates, which swing from hinges. These doors or gates could be closed and locked, in order to provide the physical security which is so essential to mankind's well-being.

House construction has changed dramatically over the centuries, but homes have remained the same in that they still feature walls having doors hung from them on hinges. Currently, most outside doors hang from hinges comprising a door blade rotatably attached to a door frame blade by means of a pintle. The pintle is rotatably attached to the door blade by means of door blade knuckles, and is also rotatably attached to the door frame blade by means of door frame blade knuckles. Most modern external doors are hung from door frames by means of external hinges, which means that the knuckles and pintle are disposed external to the door and wall when the external door is closed. The pintle is thus exposed when the external door is closed, and may be easily and quickly removed from its hinge by tapping it out with a hammer and rod, or if it is loose, by simply pulling the pintle out of the hinge by hand. Once removed, the door blade is no longer attached to the door frame blade, and even a locked external door can be thus opened by the simple expedient of removing the pintles from its hinges. The complete operation of opening a locked external door via this method can take a matter of seconds.

The fact that easily removed hinge pintles allow even locked external doors to be quickly and easily opened by unauthorized persons presents an obvious security lapse. In fact, burglars frequently employ this method to gain access through locked external doors.

Therefore, one solution to this problem is provision for a means of locking pintles within hinges in order to defeat their removal. An important design consideration is that there should be a means of unlocking the pintle, so as to provide for quick and easy door removal by authorized personnel. This is important because during the house construction phase, doors are typically installed and removed from their door frames a number of times. This occurs because a door may be sized, then removed for painting then re-installed after painting then removed to allow some oversized item to be brought through the door frame, then re-installed, etc. In addition, doors are typically removed from their frames when being re-painted. Where a house is re-painted every few years, as well as during the initial construction phase, it is clear that any hinge pintle lock design should be un-lockable to permit quick and easy door removal. Another un-lockable hinge pintle lock design consideration is retrofitability. Many existent door installations would benefit from the addition of a retrofit lockable hinge pintle and an unlockable hinge pintle lock. This could be readily accomplished if the unlockable hinge pintle lock provided for retrofit installation.

Existing Designs

One solution to the unlocked hinge pintle security problem has been the development of hinges featuring pintles permanently attached to the pintles of one blade. In this manner, the pintle is not removable at all, and the only practical way to non-destructively remove a door from its door frame is to remove all the screws fastening the hinges to either the door or to the door frame. Given a three-hinge door installation, this method of removal typically requires the removal of twelve screws, which is a relatively time-consuming and expensive method of door removal. An additional problem associated with hinges featuring permanently installed pintles, is that where a door is removed multiple times, the danger exists that the screw hole threads (generally disposed in door wood, or door frame wood) will become stripped, and thus useless. Should this occur, the hinges must be relocated along the door, which can be a time consuming and therefore expensive procedure.

A number of U.S. patents have been granted for pintle locks. U.S. Pat. No. 3,621,512 was granted Johnson for a Tamper Resistant Hinge. This patent taught a pin permanently installed in a pintle through a hinge knuckle pin hole. One disadvantage associated with this design is difficult installation: precise angular alignment is required between the pintle and the knuckle pin hole, which angular alignment is rendered difficult due to the small size (and consequent reduced visibility) of the pinhole. Another problem associated with this design is the apparent permanency of the pintle pin installation. As was previously discussed, pintle locks should be un-lockable to permit quick and easy door removal during the construction phase, and thereafter for periodic door repainting.

U.S. Pat. No. 3,733,649 was granted Nagy et al. for a Tamper Proof Door Butt Hinge Assembly featuring a removable pin keeper which fit into a pintle notch. This design suffered from a number of problems. The pin keeper is depicted as being made of thin, springy material, and fitting into a pintle notch. The pin-keeper material is necessarily thin, because the pin keeper is required to tit between the hinge blades when the door is closed. The pin keeper is taught as preventing axial pintle movement because of the sharp pintle notch comers. In practice, a sharp hammer rap against a rod resting on the bottom of the pintle would probably dislodge the thin, springy pin keeper from the pintle notch, either because of bending of the pin keeper, or because of pintle notch corner rounding. A further problem with this design is that the pin keeper may be axially visible between the hinge blades when the door is closed, thereby facilitating its defeat (and a subsequent door removal) by an unauthorized person.

SUMMARY OF THE INVENTION

Accordingly, it is an object of the present invention to provide an un-lockable hinge pintle lock and method of use which is capable of securely and positively locking a pintle within a hinge. Design features allowing this object to be accomplished include a pintle having a pintle bore, a lock blade with a lock blade aperture communicating with a knuckle aperture, and a lock having a lock tongue sized to fit into the pintle bore. Benefits associated with the accomplishment of this object include the inability to remove a pintle from its hinge from the outside of a structure, thus preventing door removal via pintle removal, thereby increasing building security.

It is another object of the present invention to provide an un-lockable hinge pintle lock which is easily locked and unlocked. Design features allowing this object to be accomplished include a lock having a lock tongue which fits into a pintle bore, a lock blade having a lock blade aperture which admits the lock, and a lock screw securing the lock in place through a lock screw hole. Advantages associated with the accomplishment of this object include quick and easy door removal by removing the pintle, along with associated time and money savings.

It is another object of this invention to provide an un-lockable hinge pintle lock which is durable and strong. Design features enabling the accomplishment of this object include a lock tongue sized to fit into a pintle bore, and a lock screw hole sized to admit a lock screw. An advantage associated with the realization of this object is less chance of unauthorized entry into a structure protected by an un-lockable hinge pintle lock.

It is still another object of this invention to provide an un-lockable hinge pintle lock which is easily installed. Design features allowing this object to be achieved include a knuckle aperture through which a pintle bore is easily visible. Benefits associated with reaching this objective include easier installation, with the attendant time and cost savings.

It is still another object of this invention to provide an un-lockable hinge pintle lock which is retrofitable to present installations. Design features enabling this object to be accomplished include a lock blade with blade screw holes, and a blade with blade screw holes. Benefits associated with the achievement of this object include enhanced security, and reduced cost.

BRIEF DESCRIPTION OF THE DRAWINGS

The invention, together with the other objects, features, aspects and advantages thereof will be more clearly understood from the following in conjunction with the accompanying drawing.

Five sheets of drawings are provided. Sheet one contains FIG. 1. Sheet two contains FIG. 2. Sheet three contains FIGS. 3 and 4. Sheet four contains FIGS. 5 and 6. Sheet five contains FIGS. 7 and 8.

DETAILED DESCRIPTION OF THE PREFERRED EMBODIMENT

Figure 1:
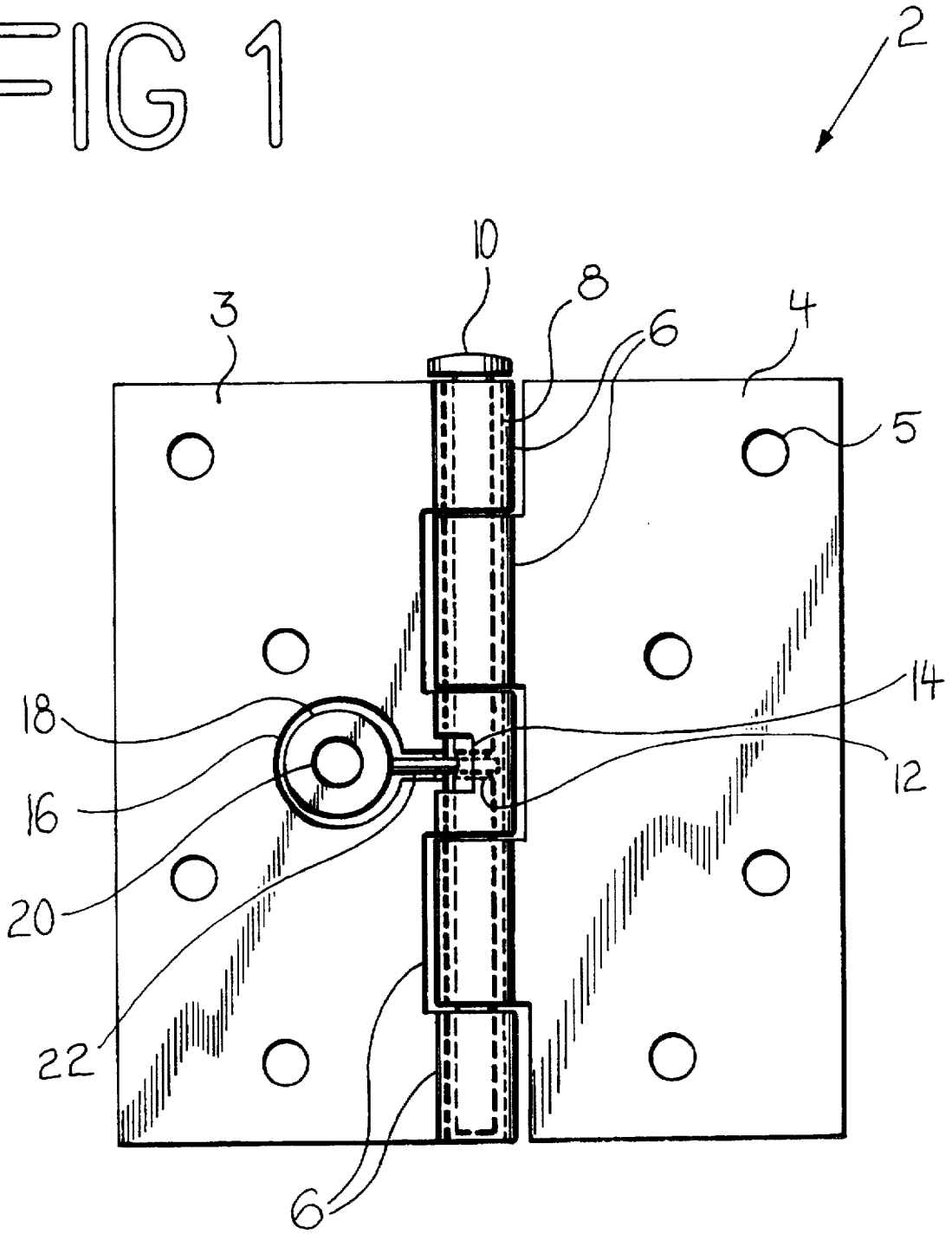
FIG. 1 is a front isometric view of an unlockable hinge pintle lock.

FIG. 1 is a front isometric view of un-lockable hinge pintle lock 2. Un-lockable hinge pintle lock comprises lock blade 3, blade 4, pintle 10, and lock 18. Look blade 3 comprises knuckles 6 having knuckle bore 8 sized to admit pintle 10. Blade 4 comprises knuckles 6 having knuckle bore 8 sized to admit pintle 10.

Lock 18 comprises lock screw hole 20 and lock tongue 22. Lock blade 3 comprises lock blade aperture 16 sized to admit lock 18. A lock blade knuckle 6 comprises knuckle aperture 14, which is sized to freely admit lock tongue 22. Pintle 10 comprises pintle bore 12 sized to admit lock tongue 22. Both blade 4 and lock blade 3 comprise blade screw holes 5 which will admit fasteners such as wood screws, by means of which blade 4 and lock blade 3 may be securely fastened to a door or door frame.

Figure 2:
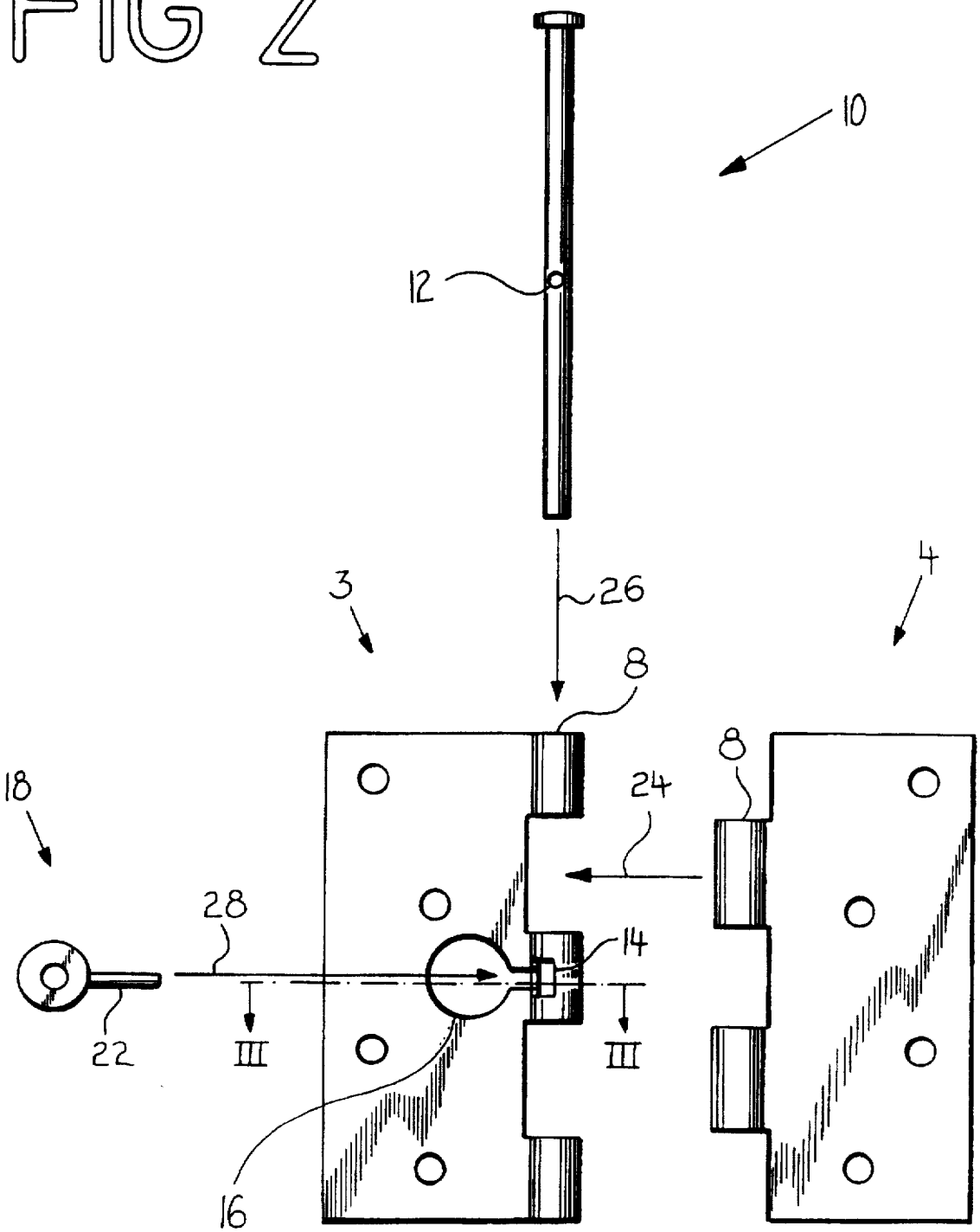
FIG. 2 is an exploded front isometric view of an unlockable hinge pintle lock.

FIG. 2 is an exploded front isometric view of an un-lockable hinge pintle lock. Un-lockable hinge pintle lock 2 is assembled by moving lock blade 3 into close proximity with blade 4 until the knuckle bores 8 in knuckles 6 of lock blade 3 line up with the knuckle bores 8 in knuckles 6 of blade 4, as indicated by arrow 24. Pintle 10 is then inserted into knuckle bores 8 as indicated by arrow 26.

Figure 3:
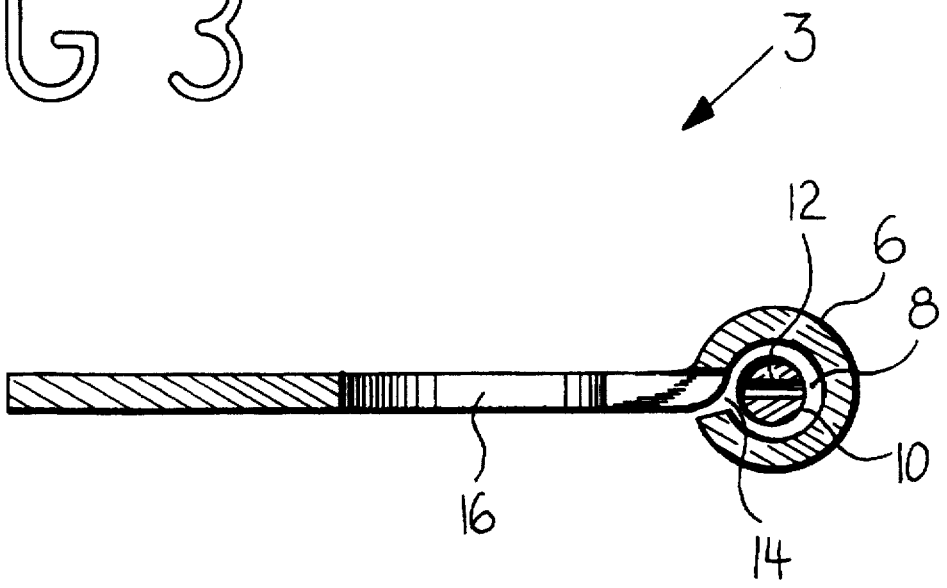
FIG. 3 is a top cross-sectional view of a lock blade taken at section III—III of FIG. 2.

When pintle 10 has been completely inserted into knuckle bores 8, and oriented so that pintle bore 12 is clearly visible through knuckle aperture 14 (as is illustrated in FIG. 3), lock 18 is moved toward pintle 10 and lock tongue 22 is inserted into pintle bore 12 as indicated by arrow 28. Look 18 is then seated within lock blade aperture 16.

FIG. 3 is a top cross-sectional view of lock blade 3 taken at section III—III of FIG. 2. Lock blade aperture 16 and knuckle aperture 14 are ready to accept lock 18 and lock tongue 22 respectively. Pintle bore 12 is in the correct angular orientation to receive lock tongue 22.

Figure 4:
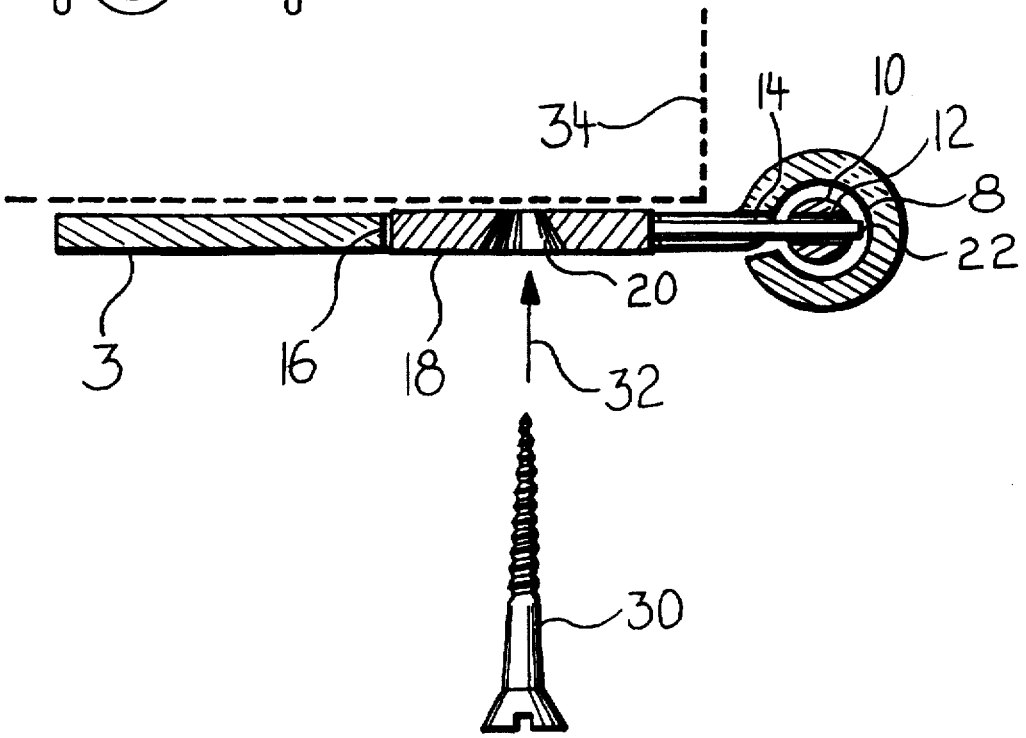
FIG. 4 is a top cross-sectional view of a lock installed in a lock blade.
Figure 5:
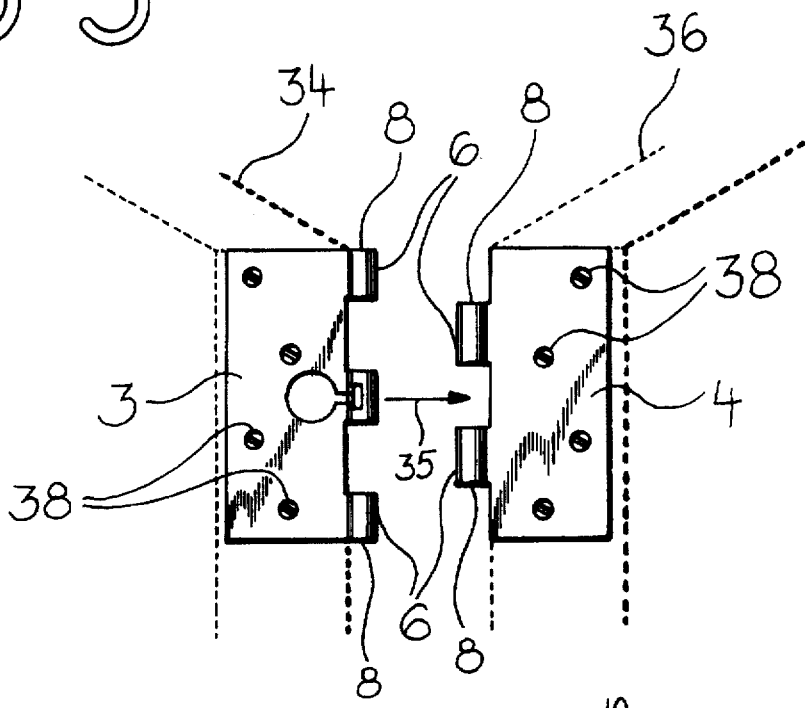
FIGS. 5–8 are front isometric views of an un-lockable hinge pintle lock having a lock blade mounted to a door, and a blade mounted to a door frame, and depicting how a pintle is locked within the unlockable hinge pintle lock.
Figure 6:
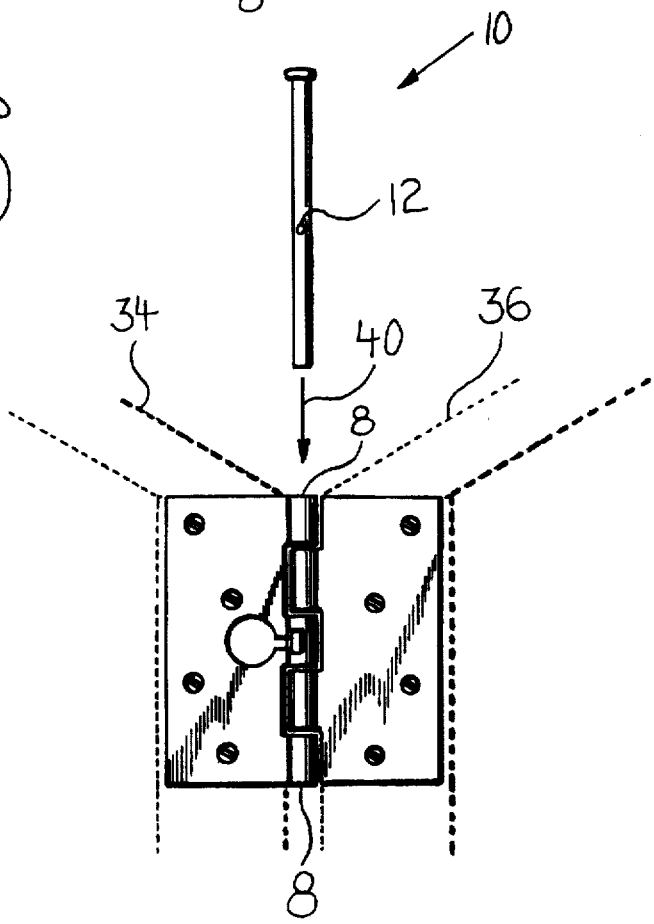

FIG. 4 is a top cross-sectional view of lock 18 installed in lock blade 3. Lock 18 is disposed within lock blade aperture 16. Lock tongue 22 is disposed within knuckle aperture 14 and pintle bore 12, thereby locking pintle 10 within knuckles 6. Lock 18 may be retained in place by means of lock screw 30 driven into door 34 through lock screw hole 20, as indicated by arrow 32 in FIG. 4.

FIGS. 5–8 are front isometric views of un-lockable hinge pintle lock 2 having lock blade 3 mounted to door 34 by means of screws 38, and blade 4 mounted to door frame 36 by means of screws 38, and depict how pintle 10 is locked within un-lockable hinge pintle lock 2. First, lock blade 3 is moved into close proximity with blade 4 until the knuckle bores 8 in knuckles 6 of lock blade 3 line up with the knuckle bores 8 in knuckles 6 of blade 4, as indicated by arrow 35. Pintle 10 is then inserted into knuckle bores 8 as indicated by arrow 40 in FIG. 6.

Figure 7:
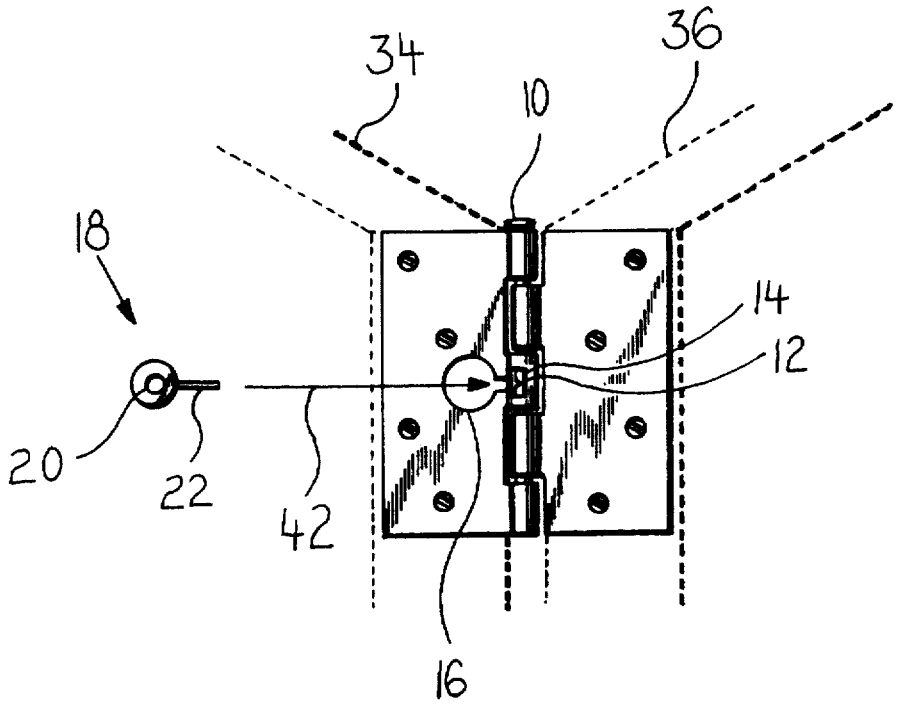

When pintle 10 has been completely inserted into knuckle bores 8, and oriented so that pintle bore 12 is clearly visible through knuckle aperture 14 (as is illustrated in FIG. 3), lock 18 is moved toward pintle 10 and lock tongue 22 is inserted into pintle bore 12 as indicated by arrow 42 in FIG. 7. Look 18 is then seated within lock blade aperture 16. Finally, lock screw 30 is screwed into door 34 through lock screw hole 20, thereby rarely immobilizing lock 18 within lock blade aperture 16, and lock tongue 22 within knuckle aperture 14 and pintle bore 12.

Figure 8:
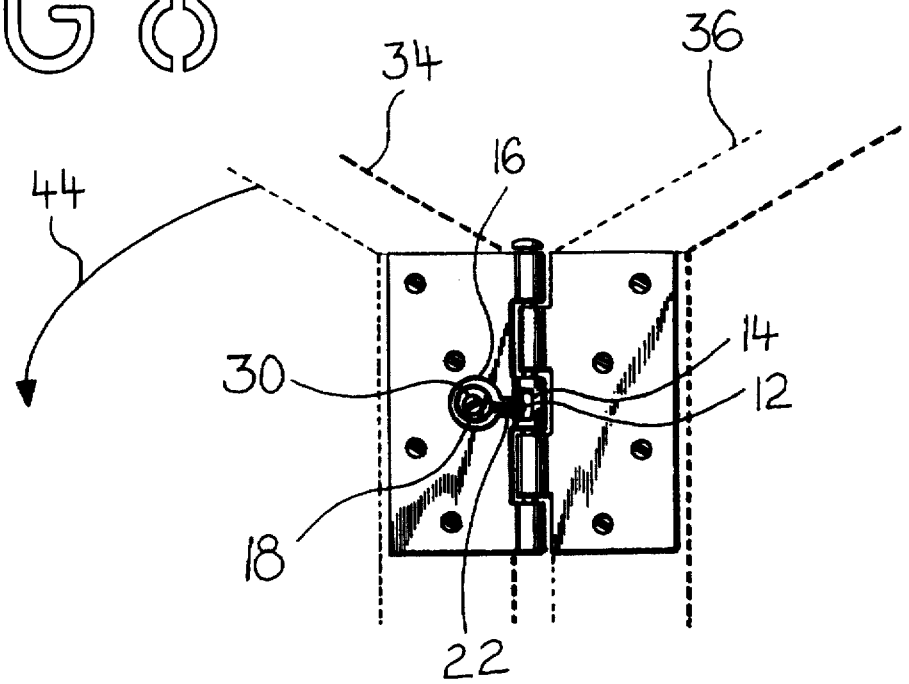

Pintle 10 is now securely locked within knuckle bores 8 by means of lock 18, as is illustrated in FIG. 8. Note that when door 34 is closed (as indicated by arrow 44), blade 4 will be immediately adjacent lock blade 3, and lock screw 30 cannot be removed, until such time as door 34 is opened. In this fashion, lock 18 securely locks pintle 10 within knuckle bores 8, thereby preventing its removal by unauthorized persons.

While the illustrations in this disclosure are directed mainly toward a door installation, it is envisioned that the instant an-lockable hinge pintle lock 2 could be used in a variety of different applications. Thus, un-lockable hinge pintle lock 2 could be used on windows, dog doors, screen doors, etc., in order improve security by locking a pintle within its hinge.

In the preferred embodiment, lock blade 3, blade 4, pintle 10 and lock 18 were manufactured of metal, synthetic, or other appropriate materials. Screws 38 and lock screw 30 were standard, off-the-shelf fasteners.

While a preferred embodiment of the invention has been illustrated herein, it is to be understood that changes and variations may be made by those skilled in the art without departing from the spirit of the appending claims.

DRAWING ITEM INDEX

2 un-lockable hinge pintle lock
3 lock blade
4 blade
5 blade screw hole
6 knuckle
8 knuckle bore
10 pintle
12 pintle bore
14 knuckle aperture
16 lock blade aperture
18 lock
20 lock screw hole
22 lock tongue
24 arrow
26 arrow
28 arrow
30 lock screw
32 arrow
34 door
35 arrow
36 door frame
38 screw
40 arrow
42 arrow
44 arrow

I claim:

1. An un-lockable hinge pintle lock comprising:

a lock blade comprising a lock blade aperture extending through said lack blade, and lock blade knuckles, each said knuckle comprising a knuckle bore;

a blade comprising blade knuckles, each said knuckle comprising a knuckle bore;

a pintle comprising a pintle bore, said pintle being removably disposed within said knuckle bores; and a lock having a thickness substantially the same as a thickness of said lock blade comprising a lock tongue, said lock being removably disposed within said lock blade aperture and said lock tongue being removably disposed within said pintle bore.

2. The un-lockable hinge pintle lock of claim 1 wherein one of the lock blade knuckles comprises a knuckle aperture extending through a knuckle wall communicating with and aligned with said lock blade aperture, said lock tongue being removably disposed through said knuckle aperture into said pintle bore.

3. The un-lockable hinge pintle lock of claim 1 wherein said lock further comprises a lock screw hole whereby said lock may be immobilized relative to said lock blade.

4. The un-lockable hinge pintle lock of claim 3 further comprising a lock screw sized to fit through said lock screw hole, whereby said lock may be immobilized relative to said lock blade.

5. The un-lockable hinge pintle lock of claim 3 wherein said lock is circular, said lock tongue extends radially from the lock circle, and said lock screw hole is circular and disposed at the center of said lock circle.

6. An un-lockable hinge pintle lock comprising:

a lock blade comprising lock blade knuckles and a lock blade aperture extending through said lock blade, each said knuckle comprising a knuckle bore, one said knuckle comprising a knuckle aperture extending through a knuckle wall communicating with and aligned with said lock blade aperture:

a blade comprising blade knuckles, each said knuckle comprising a knuckle bore;

a pintle comprising a pintle bore, said pintle being removably disposed within said knuckle bores; and a lock having a thickness substantially the same as a thickness of said lock blade comprising a lock tongue, said lock removably disposed within said lock blade aperture said lock tongue extending through said knuckle aperture into said pintle bore.

7. The un-lockable hinge pintle lock of claim 6 wherein said lock blade and said blade further comprise blade screw holes whereby said un-lockable hinge pintle lock may be firmly attached to a door and door frame.

8. A method of locking an un-lockable hinge pintle lock, said hinge pintle lock comprising:

a lock blade comprising lock blade knuckles and a lock blade aperture extending through said lock blade, each said knuckle comprising a knuckle bore, one said knuckle comprising a knuckle aperture extending through a knuckle wall communicating with and aligned with said lock blade aperture;

a blade comprising blade knuckles, each said knuckle comprising a knuckle bore;

a pintle comprising a pintle bore, said pintle removably disposed within said knuckle bores; and a lock having a thickness substantially equal to a lock blade thickness comprising a lock tongue, said lock removably disposed within said lock blade aperture, said lock tongue extending through said knuckle aperture into said pintle bore;

said locking method comprising the following steps:

A. moving said lock blade into close proximity with said blade until said knuckle bores in said knuckles of said lock blade line up with said knuckle bores in said knuckles of said blade;

B. inserting said pintle, completely into said knuckle bores;

C. orienting said pintle so that said pintle bore is clearly visible through said knuckle aperture;

D. moving said lock toward said pintle and inserting said lock tongue into said pintle bore; and E. seating said lock within said blade aperture.

9. The method locking an un-lockable hinge pintle lock of claim 8 comprising the further step of:

G. screwing a lock screw through a lock screw hole in said lock, into a surface upon which said lock blade is mounted, thereby firmly immobilizing said lock within said lock blade aperture, and said lock tongue within said knuckle aperture and said pintle bore.

10. A method of un-locking an un-lockable hinge pintle lock, said hinge pintle lock comprising:

a lock blade comprising lock blade knuckles and a lock blade aperture extending through said lock blade, each said knuckle comprising a knuckle bore, one said knuckle comprising a knuckle aperture extending through a knuckle wall communicating with and aligned with said lock blade aperture:

a blade comprising blade knuckles, each said knuckle comprising a knuckle bore;

a pintle comprising a pintle bore, said pintle removably disposed within said knuckle bores; and a lock having a thickness substantially equal to a lock blade thickness comprising a lock tongue, said lock removably disposed within said lock blade aperture, said lock tongue extending through said knuckle aperture into said pintle bore;

said un-locking method comprising the following steps:

A. unseating said lock from said lock blade aperture, and pulling said lock tongue out of said pintle bore:

B. pulling said pintle out of said knuckle bores, and

C. pulling said lock blade out of engagement with said blade.

11. The method of un-locking an un-lockable hinge pintle lock of claim 10 comprising the preliminary step of unscrewing a lock screw through a lock screw hole in said lock from a surface upon which said lock blade is mounted.

* * * * *